US010844753B2

(12) United States Patent
Uechi et al.

(10) Patent No.: US 10,844,753 B2
(45) Date of Patent: Nov. 24, 2020

(54) BOILER, STEAM-GENERATING PLANT PROVIDED WITH SAME, AND METHOD FOR OPERATING BOILER

(71) Applicant: MITSUBISHI HITACHI POWER SYSTEMS, LTD., Kanagawa (JP)

(72) Inventors: Hideyuki Uechi, Tokyo (JP); Hiroyuki Yagita, Yokohama (JP); Kuniaki Aoyama, Tokyo (JP); Hideaki Sugishita, Tokyo (JP); Yukimasa Nakamoto, Yokohama (JP); Yuichi Oka, Yokohama (JP); Naoki Hisada, Yokohama (JP); Tarou Ichihara, Yokohama (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 273 days.

(21) Appl. No.: 15/560,316

(22) PCT Filed: Mar. 22, 2016

(86) PCT No.: PCT/JP2016/058954
§ 371 (c)(1),
(2) Date: Sep. 21, 2017

(87) PCT Pub. No.: WO2016/158561
PCT Pub. Date: Oct. 6, 2016

(65) Prior Publication Data

US 2018/0058267 A1 Mar. 1, 2018

(30) Foreign Application Priority Data

Mar. 31, 2015 (JP) ..... 2015-073700

(51) Int. Cl.
*F01K 23/10* (2006.01)
*F22D 1/02* (2006.01)
(Continued)

(52) U.S. Cl.
CPC ..... *F01K 23/10* (2013.01); *F01K 11/02* (2013.01); *F01K 25/08* (2013.01); *F01K 25/10* (2013.01);
(Continued)

(58) Field of Classification Search
CPC ..... F01K 23/10
See application file for complete search history.

(56) References Cited

U.S. PATENT DOCUMENTS 2,007,309 A * 7/1935 Sengstaken ..... F22D 1/06 165/162
3,473,298 A * 10/1969 Berman ..... B01D 47/06 96/355
(Continued)

FOREIGN PATENT DOCUMENTS

CN 101334159 12/2008
CN 102362047 2/2012
(Continued)

OTHER PUBLICATIONS

International Search Report dated Jun. 14, 2016 in International Application No. PCT/JP2016/058954, with English translation.
(Continued)

*Primary Examiner* — Nathaniel Herzfeld
(74) *Attorney, Agent, or Firm* — Wenderoth, Lind & Ponack, L.L.P.

(57) ABSTRACT

A boiler including one or more evaporators, an economizer, and a low-temperature heat exchanger. The economizer is located on a downstream side of the most downstream evaporator which is an evaporator at the most downstream side among the one or more evaporators. The low-temperature heat exchanger is located on the downstream side of the economizer, has an inlet for receiving water from the out-
(Continued)

side, and is configured to heat the water introduced from the inlet and sent to the economizer with the combustion gas.

2 Claims, 8 Drawing Sheets

(51) Int. Cl.

| | |
|---|---|
| ***F22B 1/18*** | (2006.01) |
| ***F01K 25/08*** | (2006.01) |
| ***F01K 25/10*** | (2006.01) |
| ***F01K 11/02*** | (2006.01) |

(52) U.S. Cl.
CPC ..... *F22B 1/18* (2013.01); *F22B 1/1815* (2013.01); *F22D 1/02* (2013.01)

(56) References Cited

U.S. PATENT DOCUMENTS

| | | | | |
|---|---|---|---|---|
| 4,660,511 | A | 4/1987 | Anderson | |
| 5,368,096 | A | 11/1994 | Williams | |
| 6,344,177 | B1 * | 2/2002 | Littleford | B01D 47/05 422/170 |
| 2006/0130482 | A1 * | 6/2006 | Chino | F01K 17/005 60/670 |
| 2011/0100004 | A1 * | 5/2011 | Al-Mazeedi | G05B 13/021 60/641.8 |
| 2011/0113786 | A1 * | 5/2011 | Rancruel | F01K 23/10 60/772 |
| 2011/0283703 | A1 * | 11/2011 | Gu | C10J 3/482 60/670 |
| 2012/0012280 | A1 | 1/2012 | Gromoll | |
| 2012/0017597 | A1 | 1/2012 | Freund et al. | |
| 2013/0104816 | A1 * | 5/2013 | Nenmeni | F01K 23/10 122/504 |
| 2013/0283796 | A1 * | 10/2013 | Littleford | F01D 25/32 60/649 |
| 2014/0260250 | A1 | 9/2014 | Oxner et al. | |
| 2014/0260286 | A1 * | 9/2014 | El Zahab | F23J 15/003 60/772 |

FOREIGN PATENT DOCUMENTS

| | | |
|---|---|---|
| CN | 102628412 | 8/2012 |
| CN | 104006399 | 8/2014 |
| EP | 2 500 530 | 9/2012 |
| EP | 2 587 143 | 5/2013 |
| JP | 60-138214 | 7/1985 |
| JP | 07-166185 | 6/1995 |
| JP | 07-166815 | 6/1995 |
| JP | 11-118104 | 4/1999 |
| JP | 2001-033026 | 2/2001 |
| JP | 2001-208302 | 8/2001 |
| JP | 2006-194242 | 7/2006 |
| JP | 2007-250316 | 9/2007 |
| JP | 2009-097735 | 5/2009 |
| JP | 2009-264663 | 11/2009 |
| JP | 2012-026441 | 2/2012 |
| JP | 2012-057860 | 3/2012 |
| JP | 2013-204972 | 10/2013 |
| KR | 10-2012-0058582 | 6/2012 |
| WO | WO-2015088487 A1 * | 6/2015 ..... F01K 9/003 |

OTHER PUBLICATIONS

Written Opinion of the International Searching Authority dated Jun. 14, 2016 in International Application No. PCT/JP2016/058954, with English translation.

* cited by examiner

BOILER, STEAM-GENERATING PLANT PROVIDED WITH SAME, AND METHOD FOR OPERATING BOILER

TECHNICAL FIELD

The present invention relates to a boiler, a steam-generating plant including the boiler, and a method for operating the boiler.

Priority is claimed on Japanese Patent Application No. 2015-073700, filed Mar. 31, 2015, the content of which is incorporated herein by reference.

BACKGROUND ART

A waste heat recovery boiler may be connected to a gas turbine to effectively utilize heat of an exhaust gas exhausted from the gas turbine.

In the following Patent Document 1, a gas turbine plant including a gas turbine and a waste heat recovery boiler is disclosed. The gas turbine plant further includes a steam turbine driven by steam generated by the waste heat recovery boiler, a steam condenser which returns the steam which has driven the steam turbine to water, and a low boiling point medium Rankine cycle. The low boiling point medium Rankine cycle includes an evaporator which evaporates a liquid low boiling point medium, a turbine driven by an evaporated gaseous low boiling point medium, and a condenser which condenses the low boiling point medium which has driven the turbine. The evaporator of the low boiling point medium Rankine cycle exchanges heat between the liquid low boiling point medium and the steam that has driven the steam turbine to evaporate the low boiling point medium while returning the steam to water. That is, the evaporator also functions as a steam condenser of the steam turbine.

CITATION LIST

Patent Document

[Patent Document 1]
Japanese Unexamined Patent Application, First Publication No. H07-166815

SUMMARY OF INVENTION

Technical Problem

In the technology disclosed in Patent Document 1 described above, waste heat from a gas turbine is effectively utilized by introducing a low boiling point medium Rankine cycle into the gas turbine plant. However, it is preferable to more effectively utilize the heat in the combustion gas.

An object of the present invention is to provide a technology capable of more effectively utilizing heat in a combustion gas.

Solution to Problem

A boiler according to a first aspect of the invention for achieving the above-described object includes a boiler outer frame through which a combustion gas flows toward a downstream side which is an exhaust port side, one or more evaporators having at least a portion thereof located in the boiler outer frame and configured to heat water with the combustion gas to generate steam, an economizer located on the downstream side of the most downstream evaporator which is an evaporator at the most downstream side among the one or more evaporators in the boiler outer frame and configured to heat water sent to the most downstream evaporator with the combustion gas, and a low-temperature heat exchanger located on the downstream side of the economizer, having an inlet which receives water from the outside, and configured to heat the water introduced from the inlet and sent to the economizer with the combustion gas.

In this boiler, heat can be recovered from a low temperature combustion gas by the low-temperature heat exchanger.

According to the boiler of a second aspect of the invention for achieving the above-described object, in the boiler of the first aspect, the low-temperature heat exchanger may be located in the boiler outer frame.

According to the boiler of a third aspect of the invention for achieving the above-described object, in the boiler of the first aspect, a flue through which the combustion gas flowing out from the boiler outer frame flows may be connected to the boiler outer frame, a stack which releases the combustion gas from the flue to the atmosphere may be connected to the flue, and the low-temperature heat exchanger may be located in the stack or in the flue.

According to the boiler of a fourth aspect of the invention for achieving the above-described object, in the boiler in any one of the first to third aspects, the low-temperature heat exchanger may be formed of a material having higher corrosion resistance against condensate of the combustion gas than a material forming the economizer.

In this boiler, corrosion of the low-temperature heat exchanger can be suppressed even when condensate of the combustion gas is generated at a part of the low-temperature heat exchanger.

According to the boiler of a fifth aspect of the invention for achieving the above-described object, in the boiler in any one of the first to fourth aspects, the economizer and the low-temperature heat exchanger may be flange-connected.

In this boiler, even when condensate is generated at a part of the low-temperature heat exchanger and the low-temperature heat exchanger is corroded, the low-temperature heat exchanger can be easily replaced with a new low-temperature heat exchanger.

According to the boiler of a sixth aspect of the invention for achieving the above-described object, in the boiler in any one of the first to fifth aspects, the economizer may have a heat exchange ability to cool the combustion gas to a temperature higher than a dew point temperature of the combustion gas while heating water by exchanging heat between the combustion gas and the water flowing therein, and the low-temperature heat exchanger may have a heat exchange ability to cool the combustion gas until the combustion gas is condensed at least in a part of the low-temperature heat exchanger while heating water by exchanging heat between the combustion gas cooled by heat exchange in the economizer and the water flowing therein.

In this boiler, since the combustion gas is condensed at a part of the low-temperature heat exchanger, even latent heat of moisture contained in the combustion gas can be recovered.

According to the boiler of a seventh aspect of the invention for achieving the above-described object, in the boiler in any one of the first to sixth aspects, the low-temperature heat exchanger may have a heat exchange ability to cool the combustion gas to a temperature lower than the dew point temperature of the combustion gas.

In this boiler, more latent heat of moisture contained in the combustion gas can be recovered.

According to the boiler of an eighth aspect of the invention for achieving the above-described object, the boiler in any one of the first to seventh aspects may include a mist separator which separates mist liquefied from moisture contained in the combustion gas from the combustion gas, wherein the mist separator is disposed in a region in which the low-temperature heat exchanger is disposed and/or on the downstream side of the region in upstream and downstream directions in which the combustion gas flows.

In this boiler, since mist is captured by the mist separator, it is possible to reduce an amount of mist flowing in the region in which the low-temperature heat exchanger is disposed and an amount of mist flowing through a downstream side of the low-temperature heat exchanger. Therefore, in the boiler, it is possible to suppress corrosion of the low-temperature heat exchanger, corrosion of the boiler outer frame, and further, corrosion of the flue, the stack, or the like.

According to the boiler of a ninth aspect of the invention for achieving the above-described object, in the boiler of the eighth aspect, the low-temperature heat exchanger may include a plurality of low-temperature heat exchange portions arranged in the upstream and downstream directions, and the mist separator may be disposed at least in one interval among intervals between the plurality of low-temperature heat exchange portions in the upstream and downstream directions.

According to the boiler of a tenth aspect of the invention for achieving the above-described object, in the boiler of the ninth aspect, the plurality of low-temperature heat exchange portions may be flange-connected to each other.

In this boiler, when corrosion of one low-temperature heat exchange portion progresses, the one low-temperature heat exchange portion can be easily replaced with a new low-temperature heat exchange portion.

A boiler according to an eleventh aspect of the invention for achieving the above-described object includes a boiler outer frame through which a combustion gas flows toward a downstream side which is an exhaust port side, one or more evaporators having at least a portion thereof located in the boiler outer frame and configured to heat water with the combustion gas and generate steam, and an economizer located on the downstream side of the most downstream evaporator which is an evaporator at the most downstream side among the one or more evaporators in the boiler outer frame, having an inlet which receives water from the outside, and configured to heat the water introduced from the inlet and sent to the most downstream evaporator with the combustion gas, wherein the economizer has a heat exchange ability to cool the combustion gas until the combustion gas is condensed at least in a part of the economizer while heating water by exchanging heat between the combustion gas and the water flowing therein.

In this boiler, heat can be recovered from the low temperature combustion gas by the economizer. Particularly, in this boiler, since the combustion gas is condensed in a part of the economizer, even latent heat of moisture contained in the combustion gas can be recovered.

According to the boiler of a twelfth aspect of the invention for achieving the above-described object, in the boiler of the eleventh aspect, the economizer may have a heat exchange ability to cool the combustion gas to a temperature lower than a dew point temperature of the combustion gas.

In this boiler, more latent heat of moisture contained in the combustion gas can be recovered.

Here, in the steam-generating plant, the water supply line may supply water having a temperature lower than the dew point temperature of the combustion gas from the inlet into the boiler.

A steam-generating plant according to a first aspect of the invention for achieving the above-described object includes a boiler in any one of the first to twelfth aspects and a water supply line which supplies water from the inlet into the boiler.

Here, in the steam-generating plant, the water supply line may supply water having a temperature lower than the dew point temperature of the combustion gas from the inlet into the boiler.

Also, in any one of the steam-generating plants, a hot water line which introduces some of the water heated by the economizer into the water supply line may be provided.

In the steam-generating plant having the hot water line, a flow rate adjusting valve which adjusts a flow rate of water flowing through the hot water line may be provided.

In the steam-generating plant having the flow rate adjusting valve, a thermometer for determining a temperature of water in the water supply line into which the water from the hot water line is introduced may be provided and the flow rate adjusting valve may adjust the flow rate of water flowing through the hot water line so that the temperature determined by the thermometer falls within a predetermined temperature range.

Further, in any one of the steam-generating plants described above, a low boiling point medium Rankine cycle in which a low boiling point medium circulates repeatedly between condensation and evaporation may be provided, and the low boiling point medium Rankine cycle may include a heater which heats the low boiling point medium by exchanging heat between the liquid low boiling point medium and some of the water heated by the economizer.

In this steam-generating plant, since the low boiling point medium Rankine cycle is driven by utilizing some of the heat of the combustion gas, output and efficiency of the plant can be enhanced.

Further, in any one of the steam-generating plants described above having the hot water line, a low boiling point medium Rankine cycle in which a low boiling point medium circulates repeatedly between condensation and evaporation may be provided, and the low boiling point medium Rankine cycle may include a heater which heats the low boiling point medium by exchanging heat between the liquid low boiling point medium and some of the water heated by the economizer.

In this steam-generating plant, since the low boiling point medium Rankine cycle is driven by utilizing some of the heat of the combustion gas, output and efficiency of the plant can be enhanced.

A steam-generating plant according to a thirteenth aspect of the invention for achieving the above-described object includes a boiler in any one of the first to twelfth aspects, and a low boiling point medium Rankine cycle in which a low boiling point medium circulates repeatedly between condensation and evaporation, wherein the low boiling point medium Rankine cycle includes a heater which exchanges heat between the liquid low boiling point medium and some of the water heated by the economizer to heat the low boiling point medium.

Also in this steam-generating plant, since the low boiling point medium Rankine cycle is driven by utilizing some of the heat of the combustion gas, output and efficiency of the plant can be enhanced.

Further, in any one of the steam-generating plants described above, the boiler may be a waste heat recovery boiler which uses an exhaust gas exhausted from a gas turbine as the combustion gas.

Further, the gas turbine may be provided in the steam-generating plant in which the boiler is a waste heat recovery boiler.

According to a first aspect of the invention for achieving the above-described object, a method of remodeling a boiler including a boiler outer frame through which a combustion gas flows toward a downstream side which is an exhaust port side, one or more evaporators having at least a portion thereof located in the boiler outer frame and configured to heat water with the combustion gas to generate steam, and an economizer located on the downstream side of the most downstream evaporator which is an evaporator at the most downstream side among the one or more evaporators in the boiler outer frame and configured to heat water sent to the most downstream evaporator with the combustion gas, is configured to provide a low-temperature heat exchanger which heats water sent to the economizer with the combustion gas on the downstream side of the economizer in the boiler outer frame.

Here, in the method of remolding a boiler, the low-temperature heat exchanger may be formed of a material having higher corrosion resistance against condensate of the combustion gas than a material forming the economizer.

Further, in any one of the methods of remolding a boiler described above, the low-temperature heat exchanger may be flange-connected to the economizer.

In a method for operating a boiler according to a fourteenth aspect of the invention for achieving the above-described object, the boiler includes a boiler outer frame through which a combustion gas flows toward a downstream side which is an exhaust port side, one or more evaporators having at least a portion thereof located in the boiler outer frame and configured to heat water with the combustion gas to generate steam, an economizer located on the downstream side of the most downstream evaporator which is an evaporator at the most downstream side among the one or more evaporators in the boiler outer frame and configured to heat water sent to the most downstream evaporator with the combustion gas, and a low-temperature heat exchanger located on the downstream side of the economizer and configured to heat water sent to the economizer with the combustion gas, and the method includes executing an economizer heat exchange process of causing the economizer to exchange heat between the combustion gas and water flowing therein to cool the combustion gas to a temperature higher than a dew point temperature of the combustion gas while heating the water, and a low-temperature heat exchange process of causing the low-temperature heat exchanger to exchange heat between the combustion gas cooled by heat exchange in the economizer and water flowing therein to cool the combustion gas until the combustion gas is condensed at least in a part of the low-temperature heat exchanger while heating the water.

In this method for operating a boiler, heat can be recovered from a low temperature combustion gas by the low-temperature heat exchanger. Particularly, in this method for operating a boiler, since the combustion gas is condensed in a part of the economizer, even latent heat of moisture contained in the combustion gas can be recovered.

In a method for operating a boiler according to a fifteenth aspect of the invention for achieving the above-described object, the boiler of the fourteenth aspect may be configured such that the low-temperature heat exchanger is located in the boiler outer frame.

In a method for operating a boiler according to a sixteenth aspect of the invention for achieving the above-described object, a flue through which the combustion gas flowing out from the boiler outer frame flows may be connected to the boiler outer frame, a stack which releases the combustion gas from the flue to the atmosphere may be connected to the flue, and the low-temperature heat exchanger may be located in the stack or in the flue.

According to a seventeenth aspect of the invention for achieving the above-described object, in the method for operating a boiler in any of the fourteenth to sixteenth aspects, a mist separation process of separating mist liquefied from moisture contained in the combustion gas from the combustion gas in a region in which the low-temperature heat exchanger is disposed and/or on the downstream side of the region in upstream and downstream directions in which the combustion gas flows may be executed.

A method for operating a boiler according to an eighteenth aspect of the invention for achieving the above-described object, the boiler including a boiler outer frame through which a combustion gas flows toward a downstream side which is an exhaust port side, one or more evaporators having at least a portion thereof located in the boiler outer frame and configured to heat water with the combustion gas to generate steam, and an economizer located on the downstream side of the most downstream evaporator which is an evaporator at the most downstream side among the one or more evaporators in the boiler outer frame and configured to heat water sent to the most downstream evaporator with the combustion gas, includes executing an economizer heat exchange process of exchanging heat between the combustion gas and water flowing therein in the economizer to cool the combustion gas until the combustion gas is condensed at least in a part of the economizer while heating the water.

In this method for operating a boiler, heat can be recovered from a low temperature combustion gas by the economizer. Particularly, in this method for operating a boiler, since the combustion gas is condensed by a part of the economizer, even latent heat of moisture contained in the combustion gas can be recovered.

According to a nineteenth aspect of the invention for achieving the above-described object, in the method for operating a boiler in any of the fourteenth to eighteenth aspects, a Rankine cycle execution process of circulating a low boiling point medium with a low boiling point medium Rankine cycle, a heating water introduction process of introducing water heated by the economizer into the low boiling point medium Rankine cycle, and a water recovery process of returning the water having been introduced into the low boiling point medium Rankine cycle and passed the low boiling point medium Rankine cycle to the boiler may be executed, wherein the Rankine cycle execution process includes a heating process of exchanging heat between the water introduced into the low boiling point medium Rankine cycle and the liquid low boiling point medium to heat the low boiling point medium.

In this method for operating a boiler, since the low boiling point medium Rankine cycle is driven by utilizing a part of the heat of the combustion gas, output and efficiency of the plant including the boiler can be enhanced.

Advantageous Effects of the Invention

According to one aspect of the present invention, heat in combustion gas can be effectively utilized.

DESCRIPTION OF EMBODIMENTS

Hereinafter, various embodiments of a boiler and a steam-generating plant including the boiler according to the present invention will be described with reference to the drawings.

First Embodiment

Figure 1:
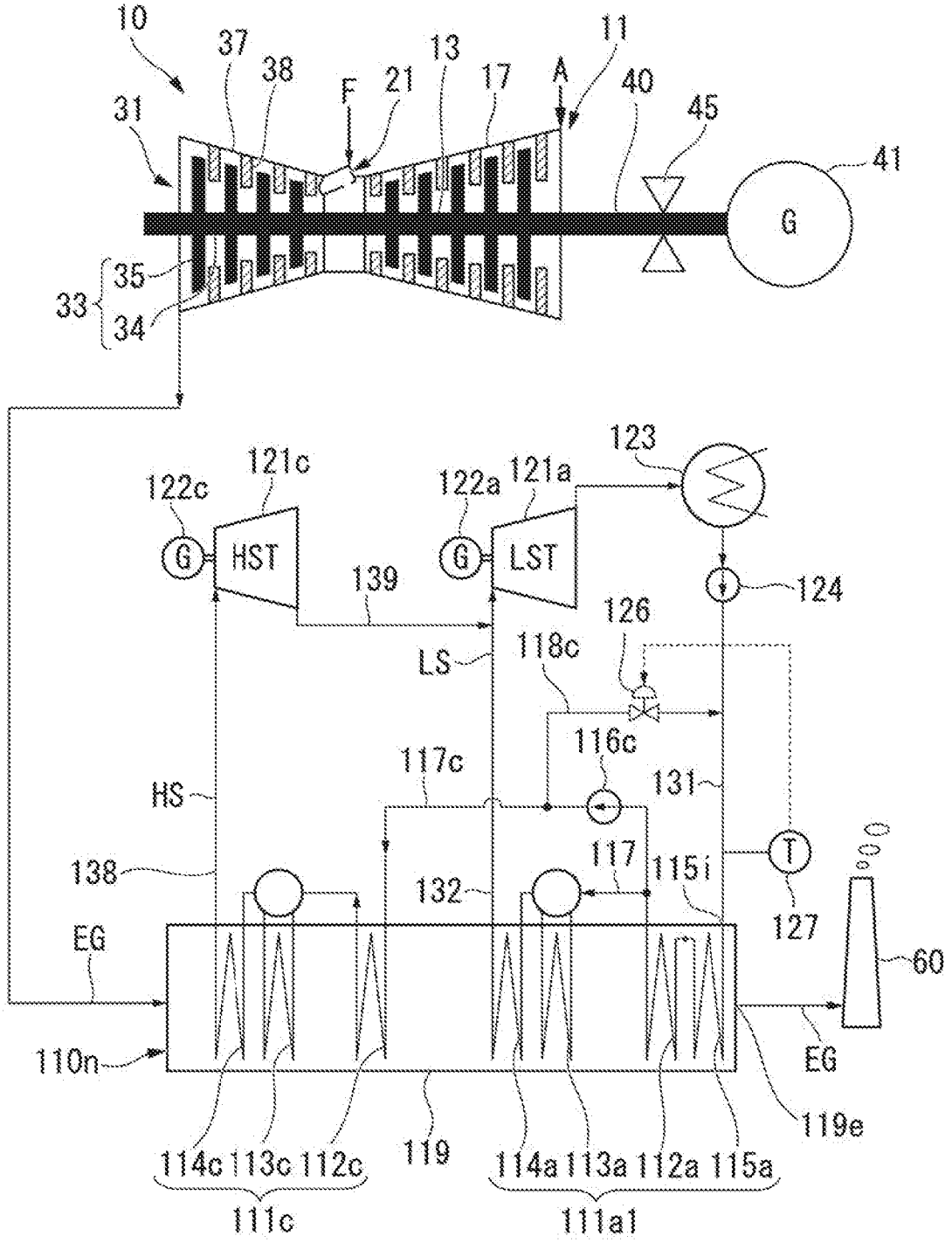
FIG. 1 is a system diagram of a steam-generating plant in a first embodiment according to the present invention.

A first embodiment of a boiler and a steam-generating plant including the boiler according to the present invention will be described with reference to FIG. 1.

The steam-generating plant of the present embodiment includes a gas turbine 10, a power generator 41, a waste heat recovery boiler 110*n*, steam turbines 121*a* and 121*c*, power generators 122*a* and 122*c*, a steam condenser 123, a water supply pump 124, and a stack 60. The power generator 41 generates electric power by driving a gas turbine 10. The waste heat recovery boiler 110*n* generates steam with heat of an exhaust gas EG exhausted from the gas turbine 10. The steam turbines 121*a* and 121*c* are driven with the steam generated in the waste heat recovery boiler 110*n*. The power generators 122*a* and 122*c* generate power by driving the steam turbines 121*a* and 121*c*. The steam condenser 123 returns the steam which has driven the steam turbine 121*a* to water. The water supply pump 124 returns the water in the steam condenser 123 to the waste heat recovery boiler 110*n*. The stack 60 releases the exhaust gas EG which has passed through the waste heat recovery boiler 100*n* to the atmosphere.

The gas turbine 10 includes a compressor 11 which compresses air A, a combustor 21 which burns fuel F in the air compressed by the compressor 11 and generates a combustion gas, and a turbine 31 driven by the combustion gas at a high temperature and high pressure. The compressor 11 includes a compressor rotor 13 which rotates about an axis and a compressor casing 17 which rotatably covers the compressor rotor 13. The turbine 31 includes a turbine rotor 33 which rotates about the axis with the combustion gas from the combustor 21 and a turbine casing 37 which rotatably covers the turbine rotor 33. The turbine rotor 33 includes a rotor shaft 34 extending in an axial direction parallel to the axis and a plurality of turbine blades 35 fixed to an outer circumference of the rotor shaft 34. A plurality of turbine vanes 38 are fixed to an inner circumferential surface of the turbine casing 37. A combustion gas flow path through which the combustion gas from the combustor 21 passes is formed between the inner circumferential surface of the turbine casing 37 and the outer circumferential surface of the rotor shaft 34.

The combustor 21 is fixed to the turbine casing 37. The turbine rotor 33 and the compressor rotor 13 rotate about the same axis and are connected to each other to form a gas turbine rotor 40. A rotor of the power generator 41 described above is connected to the gas turbine rotor 40.

In the present embodiment, the steam turbines 121*a* and 121*c* include a low-pressure steam turbine 121*a* and a high-pressure steam turbine 121*c*. The power generators 122*a* and 122*c* are respectively connected to the low-pressure steam turbine 121*a* and the high-pressure steam turbine 121*c*. Here, the power generators 122*a* and 122*c* are respectively connected to the steam turbines 121*a* and 121*c*. However, rotors of the low-pressure steam turbine 121*a* and the high-pressure steam turbine 121*c* may be connected to each other and one power generator may be connected to a total of the two steam turbines.

The waste heat recovery boiler 110*n* includes a boiler outer frame 119, a low-pressure steam generating portion 111*a*1 which generates low-pressure steam IS, and a high-pressure steam generating portion 111*c* which generates high-pressure steam HS. Both the low-pressure steam generating portion 111*a*1 and the high-pressure steam generating portion 111*c* have at least a part thereof set in the boiler outer frame 119.

The boiler outer frame 119 is connected to an exhaust port of the turbine casing 37 and the stack 60. Therefore, the combustion gas which has rotated the turbine rotor 33 is introduced into the boiler outer frame 119 as the exhaust gas EG from the gas turbine 10. The exhaust gas EG passes through the inside of the boiler outer frame 119 and is released to the atmosphere from an exhaust port 119*e* of the boiler outer frame 119 via the stack 60. In the present embodiment, the exhaust port side of the boiler outer frame 119 is designated as a downstream side of the flow of the exhaust gas EG and the opposite side thereof is designated as an upstream side.

The low-pressure steam generating portion 111*a*1 is disposed on the downstream side of the high-pressure steam generating portion 111*c*. The low-pressure steam generating portion 111*a*1 includes a low-pressure economizer 12*a* which heats water, a low-pressure evaporator (a most downstream evaporator) 113*a* which converts the water heated by the low-pressure economizer 112*a* into steam, and a low-pressure superheater 114*a* which superheats the steam generated by the low-pressure evaporator 113*a* and generates the low-pressure steam LS. The low-pressure steam generating portion 111*a*1 of the present embodiment further includes a low-temperature heat exchanger 115*a*. All of the low-pressure superheater 114*a*, the low-pressure economizer 112*a*, and the low-temperature heat exchanger 115*a* are located in the boiler outer frame 119. An evaporation drum which is a part of the low-pressure evaporator 113*a* is located outside the boiler outer frame 119. On the other hand, a heat transfer tube which is another part of the low-pressure evaporator 113*a* is located in the boiler outer frame 119. The components constituting the low-pressure steam generating portion 111*a*1 are arranged in the order of the low-pressure superheater 114*a*, the low-pressure evaporator 113*a*, the low-pressure economizer 112*a*, and the low-temperature heat exchanger 115*a* toward the downstream side.

An upstream side end of the low-temperature heat exchanger 115*a* is flange-connected to the low-pressure economizer 112*a*. That is, a flange is provided at an end on the low-pressure economizer 112*a* side of the low-temperature heat exchanger 115*a*, a flange is also provided at an end on the low-temperature heat exchanger 115*a* side of the low-pressure economizer 112*a*, and both flanges are connected by bolts. At a downstream side end of the low-temperature heat exchanger 115*a*, an inlet 115*i* for receiving water from the outside is formed. The low-temperature heat exchanger 115*a* is formed of a material having higher corrosion resistance against a condensate of the combustion gas than a material forming the low-pressure economizer 112*a*. The low-pressure economizer 112*a* is formed of, for example, carbon steel or the like. On the other hand, the low-temperature heat exchanger 115*a* is formed of an alloy in which a metal for improving corrosion resistance such as chromium or nickel is contained, for example, such as stainless steel.

The high-pressure steam generating portion 111*c* includes a high-pressure pump 116*c* which pressurizes the water heated by the low-pressure economizer 112*a*, a high-pressure economizer 112*c* which heats the water pressurized by the high-pressure pump 116*c*, a high-pressure evaporator 113*c* which converts the water heated by the high-pressure economizer 112*c* into steam, and a high-pressure superheater 114*c* which superheats the steam generated in the high-pressure evaporator 113*c* and generates the high-pressure steam HS. Both the high-pressure superheater 114*c* and the high-pressure economizer 112*c* are located in the boiler outer frame 119. The evaporation drum which is a part of the high-pressure evaporator 113*c* is located outside the boiler outer frame 119. On the other hand, the heat transfer tube which is another part of the high-pressure evaporator 113*c* is located in the boiler outer frame 119. Also, the high-pressure pump 116*c* is located outside the boiler outer frame 119. The components constituting the high-pressure steam generating portion 111*c* are arranged in the order of the high-pressure superheater 114*c*, the high-pressure evaporator 113*c*, and the high-pressure economizer 112*c* toward the downstream side. The low-pressure economizer 112*a* is connected to a low-pressure water line 117 which guides heated water by the low-pressure economizer 112*a* to the low-pressure evaporator 113*a*. The low-pressure water line 117 branches off halfway. The branched line is connected to the high-pressure economizer 112*c* as a low-pressure water branch line 117*c*. The high-pressure pump 116*c* is provided in the low-pressure water branch line 117*c*.

The steam condenser 123 and the inlet 115*i* of the low-temperature heat exchanger 115*a* are connected by a water supply line 131. The water supply pump 124 described above is provided in the water supply line 131. The low-pressure superheater 114*a* and a steam inlet of the low-pressure steam turbine 121*a* are connected by a low-pressure steam line 132 through which the low-pressure steam LS from the low-pressure superheater 114*a* is sent to the low-pressure steam turbine 121*a*. A steam outlet of the low-pressure steam turbine 121*a* and the steam condenser 123 are connected to each other so that the low-pressure steam LS which has driven the low-pressure steam turbine 121*a* is supplied to the steam condenser 123. The high-pressure superheater 114*c* and a steam inlet of the high-pressure steam turbine 121*c* are connected by a high-pressure steam line 138 through which the high-pressure steam HS from the high-pressure superheater 114*c* is sent to the high-pressure steam turbine 121*c*. A high-pressure steam recovery line 139 is connected to a steam outlet of the high-pressure steam turbine 121*c*. The high-pressure steam recovery line 139 joins the low-pressure steam line 132.

The low-pressure water branch line 117*c* is branched oil from the high-pressure economizer 112*c* side relative to the high-pressure pump 116*c*. This branch line serving as a low-pressure water circulation line 118*c* is connected to a position on the low-temperature heat exchanger 115*a* side relative to the water supply pump 124 in the water supply line 131. A flow rate adjusting valve 126 for adjusting a flow rate of water flowing therethrough is provided in the low-pressure water circulation line 118*c*. In the water supply line 131, at a position on the low-temperature heat exchanger 115*a* side relative to a connection position with the low-pressure water circulation line 118*c*, a thermometer 127 for determining a temperature of water flowing therethrough is provided. A flow rate adjusting valve 126 adjusts a flow rate of the water flowing through the low-pressure water circulation line 118*c* according to a temperature of the water determined by the thermometer 127. A hot water line which guides some of the water heated by the low-pressure economizer 112*a* into the water supply line 131 is constituted by a part of the low-pressure water line 117, a part of the low-pressure water branch line 117*c*, and the low-pressure water circulation line 118*c*.

Next, an operation of the steam-generating plant of the present embodiment will be described.

The compressor 11 of the gas turbine 10 compresses the air A and supplies the compressed air A to the combustor 21. Also, the fuel F is also supplied to the combustor 21. In the combustor 21, the fuel F is burned in the compressed air A and the combustion gas at a high temperature and high pressure is generated. The combustion gas is sent from the combustor 21 to the combustion gas flow path in the turbine 31 and rotates the turbine rotor 33. The rotation of the turbine rotor 33 causes the power generator 41 connected to the gas turbine 10 to generate electric power.

The combustion gas that has rotated the turbine rotor 33 is exhausted from the gas turbine 10 as the exhaust gas EG and is released to the atmosphere from the stack 60 via the waste heat recovery boiler 110*n*. The waste heat recovery boiler 110*n* recovers heat contained in the exhaust gas EG in the process in which the exhaust gas EG from the gas turbine 10 passes through the waste heat recovery boiler 110*n*.

In the waste heat recovery boiler 100*n*, water is supplied from the water supply line 131 to the low-temperature heat exchanger 115*a* on the most downstream side. The water supplied to the low-temperature heat exchanger 115*a* includes some of the water heated by the low-pressure economizer 112*a* in some cases in addition to the water from the steam condenser 123. Some of the water heated by the low-pressure economizer 112*a* is introduced into the water supply line 131 via the low-pressure water branch line 117*c* and the low-pressure water circulation line 118*c*. The flow rate adjusting valve 126 provided in the low-pressure water circulation line 118*c* sends the water heated by the low-pressure economizer 112*a* to the water supply line 131 within a range in which the temperature of the water determined by the thermometer 127 is not equal to or higher than a dew point temperature of the exhaust gas EG. Therefore, water having a temperature lower than the dew point temperature of the exhaust gas EG is supplied to the low-temperature heat exchanger 115*a*.

Further, the dew point temperature of the exhaust gas EG is, for example, about 45 to 50° C. However, this dew point temperature is an example, and the dew point temperature of the exhaust gas EG may be higher than 50° C. or lower than 45° C. when physical properties or the like of the fuel F burning in the combustor 21 of the gas turbine 10 are changed. When the dew point temperature of the exhaust gas EG is about 45 to 50° C. as described above, water of 35 to 40° C., for example, is supplied to the low-temperature heat exchanger 115*a*.

The low-temperature heat exchanger 115*a* cools the exhaust gas EG while heating water by exchanging heat between the exhaust gas EG and the water flowing therein (a low temperature heat exchange process). In the low-temperature heat exchanger 115*a*, water having a temperature lower than the dew point temperature of the exhaust gas EG is heated to a temperature higher than the dew point temperature. In addition, in the low-temperature heat exchanger 115*a*, the exhaust gas EG is cooled until the exhaust gas EG is condensed at least in a part of the low-temperature heat exchanger 115*a*, for example, locally in a surface of the low-temperature heat exchanger 115*a*. However, here, the temperature of the exhaust gas EG having passed the low-temperature heat exchanger 115*a* is equal to or higher than the dew point temperature thereof on average. That is, the low-temperature heat exchanger 115*a* has a heat exchange ability to cool the exhaust gas EG until the exhaust gas EG is condensed at least in a part of the low-temperature heat exchanger 115*a* while heating the water by exchanging heat between the exhaust gas EG and the water flowing therein.

The water heated by the low-temperature heat exchanger 115*a* is introduced into the low-pressure economizer 112*a*. Also in the low-pressure economizer 112*a*, the exhaust gas EG is cooled while heating water by exchanging heat between the exhaust gas EG and the water flowing therein. In the low-pressure economizer 112*a*, water having a temperature higher than the dew point temperature of the exhaust gas EG is heated to an even higher temperature. Also, in the low-pressure economizer 112*a*, the exhaust gas EG is cooled to a temperature higher than the dew point temperature thereof. Therefore, the exhaust gas EG having a temperature higher than the dew point temperature flows into the low-temperature heat exchanger 115*a* described above.

Some of the water heated by the low-pressure economizer 112*a* is further heated by the low-pressure evaporator 113*a* and becomes steam. This steam is further superheated by the low-pressure superheater 114*a* and is supplied to the low-pressure steam turbine 121*a* via the low-pressure steam line 132 as the low-pressure steam IS. The steam which has driven the low-pressure steam turbine 121*a* returns to water in the steam condenser 123. The water in the steam condenser 123 is pressurized by the water supply pump 124 and is sent to the low-temperature heat exchanger 115*a* of the waste heat recovery boiler 110*n* via the water supply line 131.

Another part of the water heated by the low-pressure economizer 112*a* is pressurized by the high-pressure pump 116*c*. Some of the water pressurized by the high-pressure pump 116*c* is supplied to the water supply line 131 via the low-pressure water circulation line 118*c* as described above. Also, another part of the water pressurized by the high-pressure pump 116*c* is sent to the high-pressure economizer 112*c* via the low-pressure water branch line 117*c*.

The high-pressure economizer 112*c* heats the water sent from the high-pressure pump 116*c* by exchanging heat with the exhaust gas EG. The water heated by the high-pressure economizer 112*c* is further heated by the high-pressure evaporator 113*c* and becomes steam. This steam is further superheated by the high-pressure superheater 114*c* and becomes the high-pressure steam HS. The high-pressure steam HS is supplied to the high-pressure steam turbine 121*c* via the high-pressure steam line 138 to drive the high-pressure steam turbine 121*c*. The steam which has driven the high-pressure steam turbine 121*c* passes through the high-pressure steam recovery line 139 and the low-pressure steam line 132 and is supplied to the low-pressure steam turbine 121*a* to drive the low-pressure steam turbine 121*a*. The steam which has driven the low-pressure steam turbine 121*a* returns to water in the steam condenser 123 as described above.

In the present embodiment, heat can be recovered from the low temperature exhaust gas EG by the low-temperature heat exchanger 115*a*. Particularly, in the present embodiment, since the exhaust gas EG is condensed in a part of the low-temperature heat exchanger 115*a*, latent heat of moisture contained in the exhaust gas EG can also be recovered. Therefore, in the present embodiment, heat in the exhaust gas EG can be effectively utilized and efficiency of the steam-generating plant can be increased.

In addition, in the present embodiment, not only when a new boiler is located but also when an existing boiler is remodeled, it is possible to increase efficiency of the existing boiler by adding the low-temperature heat exchanger 115*a* described above.

In the present embodiment, as described above, the exhaust gas EG is condensed in a part of the low-temperature heat exchanger 115*a*. In the present embodiment, since the low-temperature heat exchanger 115*a* is formed of stainless steel or the like having high corrosion resistance against condensate of the exhaust gas EG, corrosion of the low-temperature heat exchanger 115*a* by the condensate can be suppressed. Also, in the present embodiment, since the low-temperature heat exchanger 115*a* is flange-connected to the low-pressure economizer 112*a*, it is possible to easily release the connection between the low-temperature heat exchanger 115*a* and the low-pressure economizer 112*a*. Therefore, in the present embodiment, when the low-temperature heat exchanger 115*a* is assumed to be severely damaged by corrosion, the low-temperature heat exchanger 115*a* can be easily replaced with a new low-temperature heat exchanger 115*a*. Also, since the low-temperature heat exchanger 115*a* and the low-pressure economizer 112*a* are provided separately and are coupled together, only the low-temperature heat exchanger 115*a* in which the exhaust gas EG is likely to condense is made of a material having high corrosion resistance and the low-pressure economizer 112*a* can be made of a general material. With such a configuration, it is possible to reduce cost while preventing corrosion by limiting a place in which an expensive material having high corrosion resistance is used to the low-temperature heat exchanger 115*a*.

Here, in the present embodiment, the low-temperature heat exchanger 115*a* is formed of a material having high corrosion resistance such as stainless steel, and the low-temperature heat exchanger 115*a* is flange-connected to the low-pressure economizer 112*a*. However, when the low-temperature heat exchanger 115*a* is formed of a material having high corrosion resistance such as stainless steel, the low-temperature heat exchanger 115*a* may not be connected with the low-pressure economizer 112*a* by a flange connection. Also, when the low-temperature heat exchanger 115*a* and the low-pressure economizer 112*a* are flange-connected, the low-temperature heat exchanger 115*a* may not be formed of a material having high corrosion resistance such as stainless steel.

Also, in the present embodiment, by the low-temperature heat exchanger 115*a*, the exhaust gas EG having a temperature higher than the dew point temperature is cooled to a temperature equal to or higher than the dew point temperature. However, by the low-temperature heat exchanger, the exhaust gas EG having a temperature higher than the dew point temperature or the exhaust gas EG having a temperature equal to higher than the dew point temperature may be cooled to a temperature lower than the dew point temperature. In this way, in a case of changing the low-temperature heat exchanger, when a temperature of water introduced into the low-temperature heat exchanger is the same as in the present embodiment, it is necessary to make a heat transfer area of the low-temperature heat exchanger greater than a heat transfer area of the low-temperature heat exchanger 115*a* of the present embodiment. As described above, when the exhaust gas EG is cooled to below the dew point temperature by the low-temperature heat exchanger, latent heat of moisture contained in the exhaust gas EG can be recovered also by the present embodiment.

Second Embodiment

Figure 2:
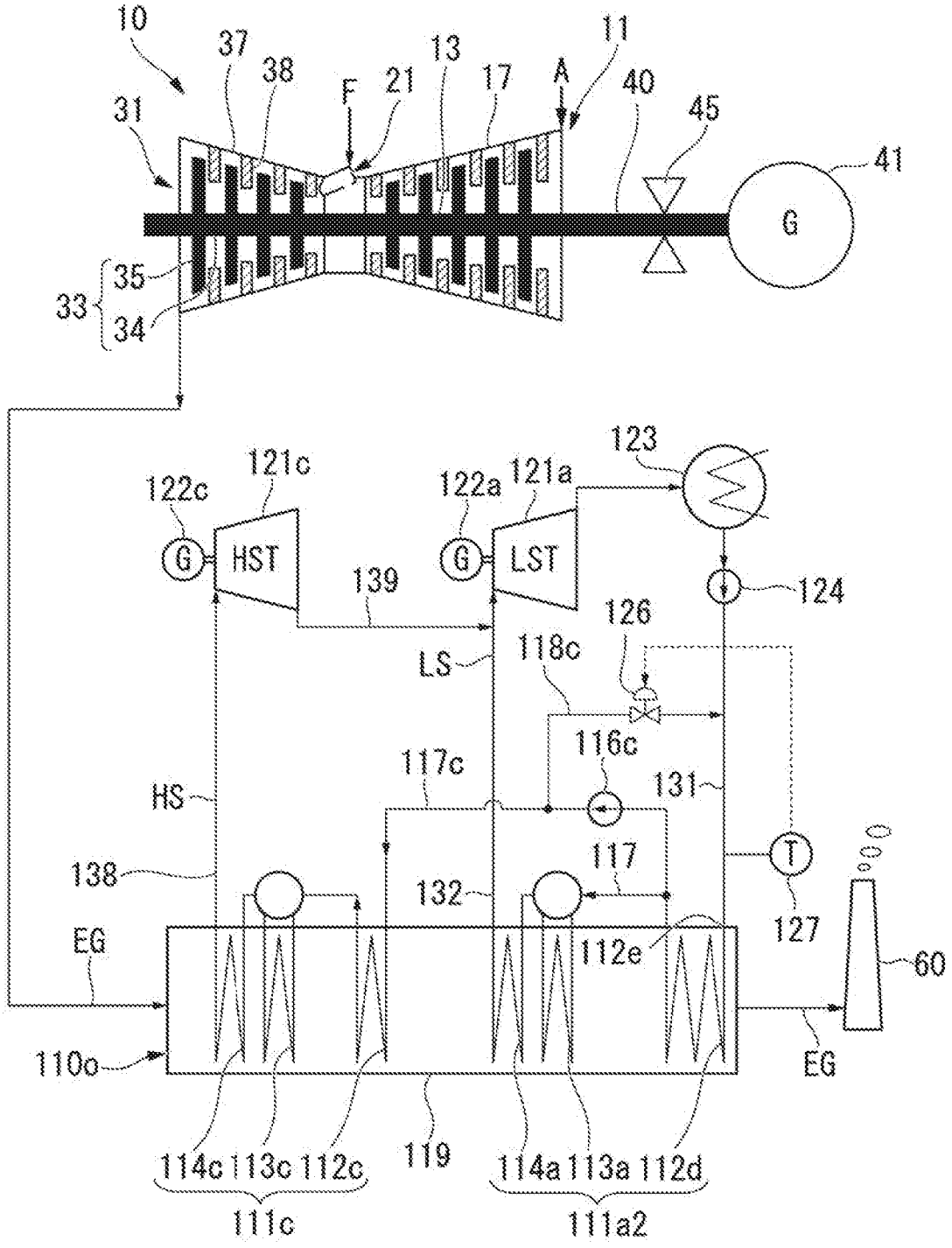
FIG. 2 is a system diagram of a steam-generating plant in a second embodiment according to the present invention.

A second embodiment of a boiler and a steam-generating plant including the boiler according to the present invention will be described with reference to FIG. 2.

In the steam-generating plant of the present embodiment, the low-temperature heat exchanger 115*a* and the low-pressure economizer 112*a* in the steam-generating plant of the first embodiment are integrated to serve as a low-pressure economizer 112*d*, and other configurations are the same as those in the first embodiment. Therefore, a low-pressure steam generating portion 111*a*2 of a waste heat recovery boiler 110*o* of the present embodiment includes the low-pressure economizer 112*d*, a low-pressure evaporator 113*a*, and a low-pressure superheater 114*a*, but does not include a low-temperature heat exchanger as an independent unit.

An inlet 112*i* for receiving water from the outside is formed at a downstream side end of the low-pressure economizer 112*d* of the present embodiment. A water supply line 131 is connected to this inlet 112*i*. As in the steam-generating plant of the first embodiment, a low-pressure water circulation line 118*c* is connected also to the water supply line 131. As in the first embodiment, the low-pressure water circulation line 118*c* constitutes a part of a hot water line which guides some of water heated by the low-pressure economizer 112*d* into the water supply line 131. A flow rate adjusting valve 126 for adjusting a flow rate of water flowing therethrough is provided in the low-pressure water circulation line 118*c*. In the water supply line 131, at a position on the low-temperature heat exchanger 115*a* side relative to a connection position with the low-pressure water circulation line 118*c*, a thermometer 127 for determining a temperature of water flowing therethrough is provided.

Next, an operation of the steam-generating plant of the present embodiment will be described.

In the waste heat recovery boiler 110*o*, water is supplied from the water supply line 131 to the low-pressure economizer 112*d* on the most downstream side. The water supplied to the low-pressure economizer 112*d* includes some of the water heated by the low-pressure economizer 112*d* in some cases in addition to water from a steam condenser 123. Some of the water heated by the low-pressure economizer 112*d* is introduced into the water supply line 131 via a low-pressure water branch line 117*c* and the low-pressure water circulation line 118*c*. A flow rate adjusting valve 126 provided in the low-pressure water circulation line 118*c* sends the water heated by the low-pressure economizer 112*d* to the water supply line 131 within a range in which the temperature of the water determined by the thermometer 127 is not equal to or higher than a dew point temperature of the exhaust gas EG. Therefore, water having a temperature lower than the dew point temperature of the exhaust gas EG is supplied to the low-pressure economizer 112*d*.

The low-pressure economizer 112*d* cools the exhaust gas EG while heating water by exchanging heat between the exhaust gas EG and the water flowing therein (economizer heat exchange process). In the low-pressure economizer 112*d*, water having a temperature lower than the dew point temperature of the exhaust gas EG is heated to a temperature higher than the dew point temperature. In addition, in the low-pressure economizer 112*d*, in the low-temperature heat exchanger 115*a*, the exhaust gas EG is cooled until the exhaust gas EG is condensed at least in a part of the low-temperature heat exchanger 115*a*, for example, locally in a surface of the low-temperature heat exchanger 115*a*. However, here, the temperature of the exhaust gas EG having passed the low-temperature heat exchanger 115*a* is equal to or higher than the dew point temperature thereof on average. That is, the low-pressure economizer 112*d* has a heat exchange ability to cool the exhaust gas EG until the exhaust gas EG is condensed at least in a part of the low-pressure economizer 112*d* while heating the water by exchanging heat between the exhaust gas EG and the water flowing therein. Therefore, a heat transfer area of the low-pressure economizer 112*d* of the present embodiment is greater than the heat transfer area of the low-pressure economizer 112*a* in the steam-generating plant of the first embodiment.

As in the steam-generating plant of the first embodiment, some of the water heated by the low-pressure economizer 112*d* is further heated by the low-pressure evaporator 113*a* and becomes steam. This steam is further superheated by the low-pressure superheater 114*a* and is supplied to a low-pressure steam turbine 121*a* via a low-pressure steam line 132 as low-pressure steam LS. Another part of the water heated by the low-pressure economizer 112*d* is pressurized by a high-pressure pump 116*c*. Some of the water pressurized by the high-pressure pump 116*c* is supplied to the water supply line 131 via the low-pressure water circulation line 118*c* as described above. Another part of the water pressurized by the high-pressure pump 116*c* is sent to a high-pressure economizer 112*c* via the low-pressure water branch line 117*c*.

Also in the present embodiment, heat can be recovered from the low temperature exhaust gas EG by the low-pressure economizer 112*d*. Particularly, in the present embodiment, since the exhaust gas EG is condensed in a part of the low-pressure economizer 112*d*, latent heat of moisture contained in the exhaust gas EG can also be recovered. Therefore, also in the present embodiment, heat in the exhaust gas EG can be effectively utilized and efficiency of the steam-generating plant can be increased.

Here, in the present embodiment, by the low-pressure economizer 112*d*, the exhaust gas EG having a temperature higher than the dew point temperature is cooled to a temperature equal to or higher than the dew point temperature. However, the exhaust gas EG having a temperature higher than the dew point temperature may be cooled to a temperature lower than the dew point temperature by the low-pressure economizer. In this way, in a case of changing the low-pressure economizer, when a temperature of water introduced into the low-pressure economizer is the same as in the present embodiment, it is necessary to make a heat transfer area of the low-pressure economizer greater than a heat transfer area of the low-pressure economizer 112*d* of the present embodiment. As described above, when the exhaust gas EG is cooled to below the dew point temperature by the low-pressure economizer, latent heat of moisture contained in the exhaust gas EG can be recovered also by the present embodiment.

Third Embodiment

Figure 3:
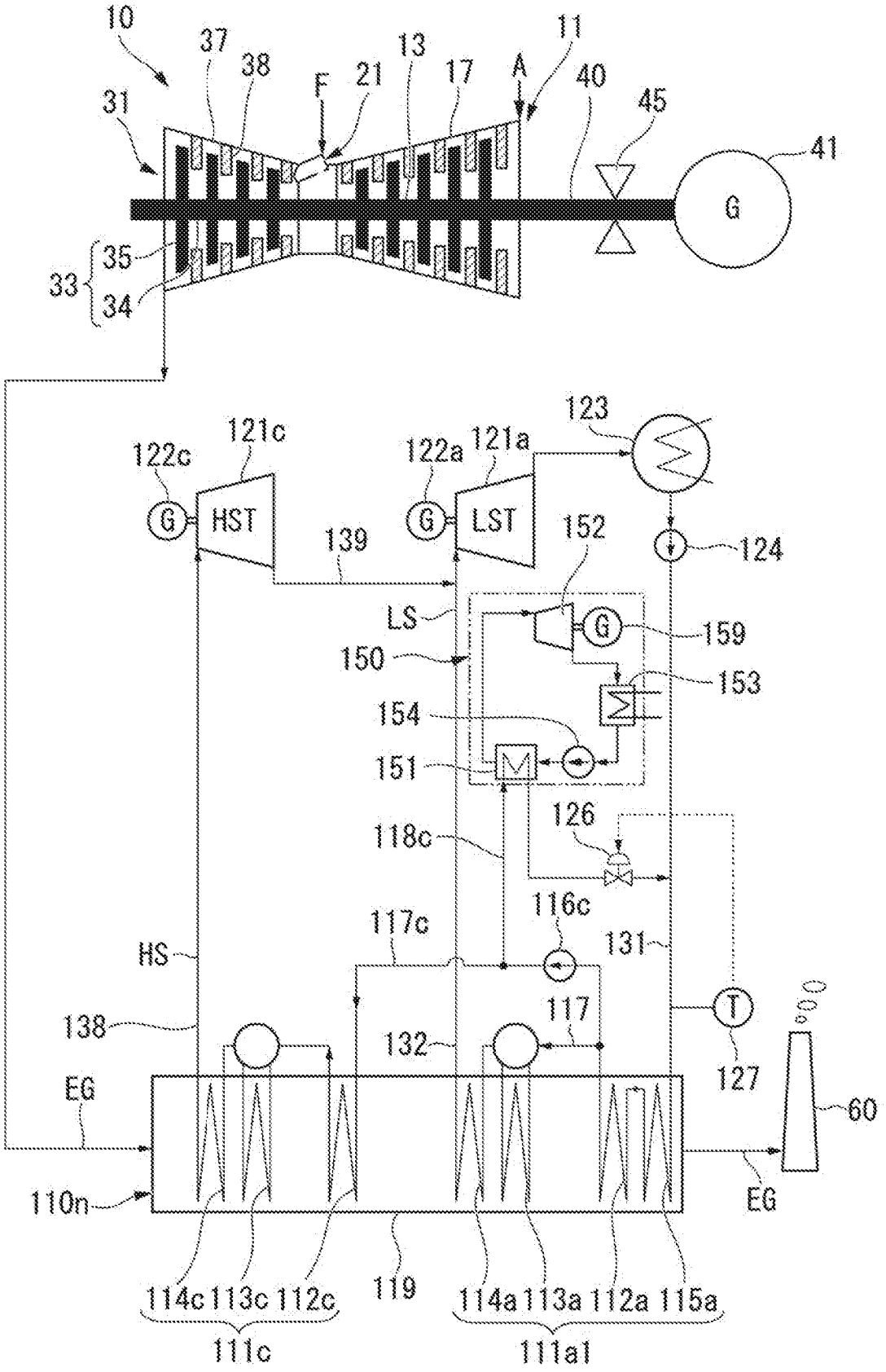
FIG. 3 is a system diagram of a steam-generating plant in a third embodiment according to the present invention.

A third embodiment of a boiler and a steam-generating plant including the boiler according to the present invention will be described with reference to FIG. 3.

In the steam-generating plant of the present embodiment, a low boiling point medium Rankine cycle 150 driven by using heat of water heated by a low-pressure economizer 112*a* is added to the steam-generating plant of the first embodiment.

The Rankine cycle is a cycle for driving a turbine with steam. On the other hand, the low boiling point medium Rankine cycle 150 is a cycle in which a turbine 152 is driven using a medium having a boiling point lower than that of water (hereinafter referred to as a low boiling point medium).

Examples of the low boiling point medium include the following substances.

- Organic halogen compounds such as trichloroethylene, tetrachloroethylene, monochlorobenzene, dichlorobenzene, and perfluorodecalin.
- Alkanes such as butane, propane, pentane, hexane, heptane, octane, and decane.
- Cyclic alkanes such as cyclopentane and cyclohexane.
- Thiophene, ketones, and aromatic compounds
- Refrigerants such as R134a and R245fa.
- Combinations of the above.

The low boiling point medium Rankine cycle 150 includes an evaporator (a heater) 151 which heats and evaporates a liquid low boiling point medium, the turbine 152 driven by the evaporated low boiling point medium, a condenser 153, and a low boiling point medium pump 154. For example, a power generator 159 which generates power by the driving of the turbine 152 is connected to the turbine 152. The condenser 153 cools and condenses the low boiling point medium which has driven the turbine 152. The condenser 153 is one type of heat exchanger, and exchanges heat between the low boiling point medium and a cooling medium such as water. The low boiling point medium pump 154 returns the low boiling point medium condensed by the condenser 153 to the evaporator 151. The evaporator (heater) 151 is also one type of heat exchanger, and exchanges heat between the liquid low boiling point medium and water heated by the low-pressure economizer 112*a*.

A low-pressure water circulation line 118*c* is connected to the evaporator 151 of the low boiling point medium Rankine cycle 150. Specifically, a heating water inlet of the evaporator 151 is connected to the low-pressure economizer 112*a* side of the low-pressure water circulation line 118*c* and a heating water outlet of the evaporator 151 is connected to a water supply line 131 side of the low-pressure water circulation line 118*c*. A flow rate adjusting valve 126 is provided between the evaporator 151 and the water supply line 131 in the low-pressure water circulation line 118*c*.

Some of the water heated by the low-pressure economizer 112*a* is pressurized by a high-pressure pump 116*c* and is supplied to the evaporator 151 of the low boiling point medium Rankine cycle 150 via the low-pressure water circulation line 118*c* (heating water introduction process).

In the evaporator 151, heat is exchanged between a liquid low boiling point medium and the water heated by the low-pressure economizer 112*a*, and the liquid low boiling point medium is heated and evaporated (heating process). In this process, the water is cooled and flows out from the heating water outlet of the evaporator 151. The water that flows out from the heating water outlet of the evaporator 151 is introduced into the water supply line 131 via the low-pressure water circulation line 118*c*. This water mixes with the water from a steam condenser 123, flows through the water supply line 131, and returns to a low-temperature heat exchanger 115*a* (water recovery process).

The low boiling point medium evaporated by the evaporator 151 drives the turbine 152 which is a component of the low boiling point medium Rankine cycle 150. The low boiling point medium which has driven the turbine 152 is sent to the condenser 153. In the condenser 153, heat is exchanged between the low boiling point medium and the cooling medium, and the low boiling point medium is cooled and condensed. The condensed low boiling point medium is sent to the evaporator 151 by the low boiling point medium pump 154, and as described above, exchanges heat with water in the evaporator 151. As described above, the low boiling point medium circulates in the low boiling point medium Rankine cycle 150 (Rankine cycle execution process).

As described above, in the present embodiment, since the low boiling point medium Rankine cycle 150 is driven by utilizing the heat of the exhaust gas EG, output and efficiency of the plant can be increased.

Further, in the present embodiment, the low boiling point medium Rankine cycle 150 is added to the first embodiment of the steam-generating plant, but the low boiling point medium Rankine cycle 150 may be added to the second embodiment of the steam-generating plant.

Also, the low boiling point medium Rankine cycle 150 exemplarily shown here is the most basic mode of the low boiling point medium Rankine cycle, and other aspects of the low boiling point medium Rankine cycle may be employed. For example, a preheater which heats the condensed low boiling point medium by exchanging heat between the low boiling point medium condensed by the condenser 153 and the low boiling point medium which has driven the turbine 152 may be added to the low boiling point medium Rankine cycle 150 of the embodiments described above. Further, a plurality of evaporators 151 may be connected in series or in parallel to the condenser 153, and a turbine 152 may be provided for each of the plurality of evaporators 151.

Fourth Embodiment

Figure 4:
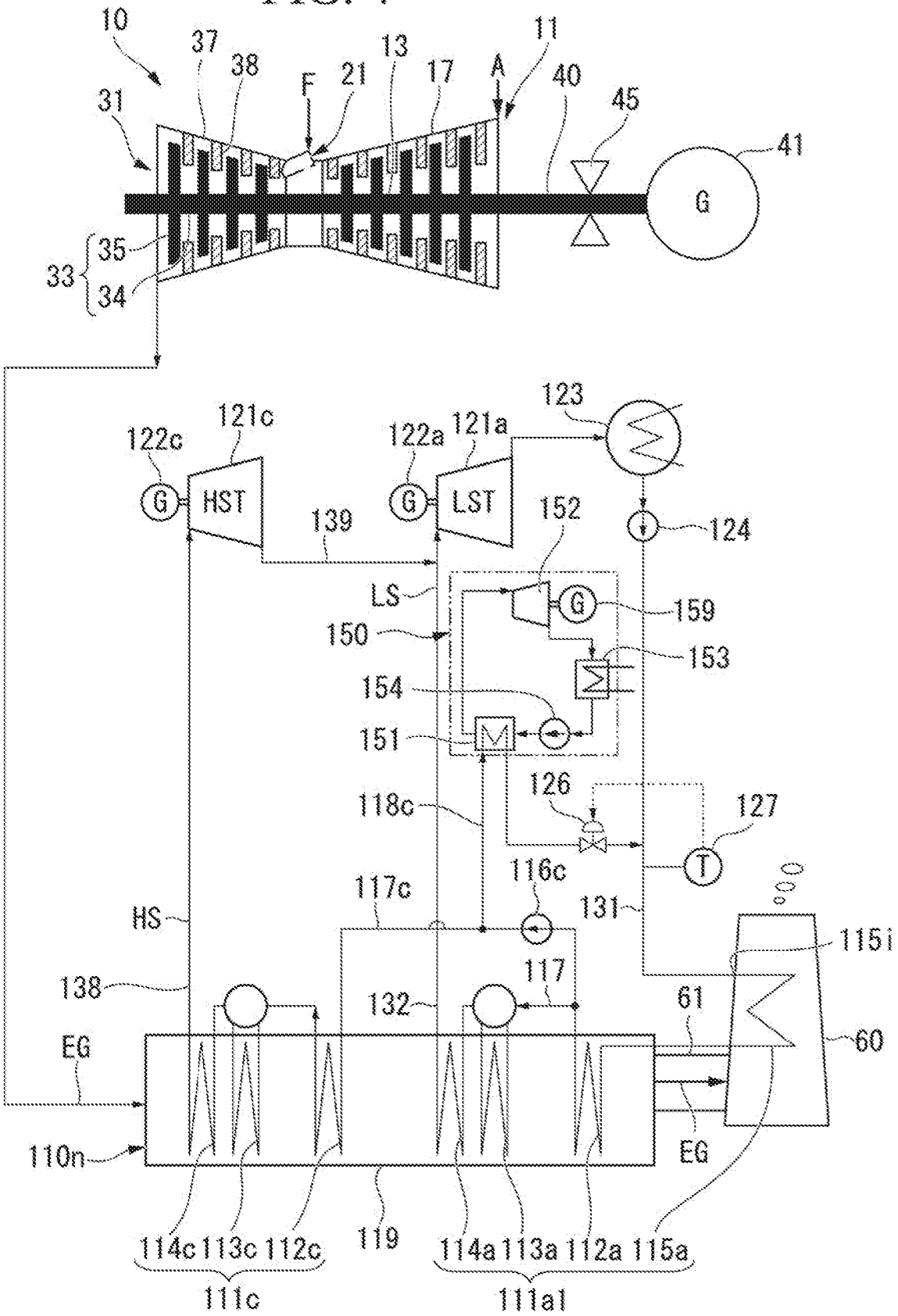
FIG. 4 is a system diagram of a steam-generating plant in a fourth embodiment according to the present invention.

A fourth embodiment of a boiler and a steam-generating plant including the boiler according to the present invention will be described with reference to FIG. 4.

The present embodiment is a modified example of the third embodiment. In the third embodiment, the low-temperature heat exchanger 115*a* is located in the boiler outer frame 119. In the present embodiment, a low-temperature heat exchanger 115*a* is located in a stack 60. A flue 61 is connected to a downstream end of a boiler outer frame 119. The stack 60 is connected to a downstream end of the flue 61. An exhaust gas EG from the boiler outer frame 119 passes through the flue 61 and the stack 60 and is released to the atmosphere from the stack 60.

As in the first and third embodiments, a water supply line 131 is connected to an inlet 115*i* of the low-temperature heat exchanger 115*a* in the present embodiment. An upstream side end of the low-temperature heat exchanger 115*a* is connected to a low-pressure economizer 112*a* in the boiler outer frame 119. Further, a connection between the upstream side end of the low-temperature heat exchanger 115*a* and the low-pressure economizer 112*a* may be a flange connection as in the first and third embodiments, but may also be a welded connection. In addition, the low-temperature heat exchanger 115*a* may be formed of a material having higher corrosion resistance than a material forming the low-pressure economizer 112*a* as in the first and third embodiments.

In the present embodiment, water from the water supply line 131 is supplied to the low-temperature heat exchanger 115*a* in the stack 60. The low-temperature heat exchanger 115*a* cools the exhaust gas EG while heating the water by exchanging heat between the exhaust gas EG in the stack 60 and the water flowing therein (low-temperature heat exchange process). In the low-temperature heat exchanger 115*a*, water having a temperature lower than a dew point temperature of the exhaust gas EG is heated to a temperature higher than the dew point temperature. In addition, in the low-temperature heat exchanger 115*a*, the exhaust gas EG is cooled until the exhaust gas EG is condensed at least in a part of the low-temperature heat exchanger 115*a*, for example, locally in a surface of the low-temperature heat exchanger 115*a*. That is, as in the first and third embodiments, the low-temperature heat exchanger 115*a* also has a heat exchange ability to cool the exhaust gas EG until the exhaust gas EG is condensed at least in a part of the low-temperature heat exchanger 115*a* while heating the water by exchanging heat between the exhaust gas EG and the water flowing therein.

The water heated by the low-temperature heat exchanger 115*a* is introduced into the low-pressure economizer 112*a*. As in the embodiments described above, also in the low-pressure economizer 112*a*, the exhaust gas EG is cooled while the water is heated by exchanging heat between the exhaust gas EG and the water flowing therein (economizer heat exchange process). In the low-pressure economizer 112*a*, water having a temperature higher than the dew point temperature of the exhaust gas EG is heated to an even higher temperature. Also, in the low-pressure economizer 112*a*, the exhaust gas EG is cooled to a temperature higher than the dew point temperature thereof.

As in the third embodiment, since the low boiling point medium Rankine cycle 150 is provided also in the present embodiment and the low boiling point medium Rankine cycle 150 is driven by utilizing the heat of the exhaust gas EG, output and efficiency of the plant can be increased.

Further, in the present embodiment, since the low-temperature heat exchanger 115*a* is located in the stack 60, as compared with a case in which the boiler outer frame 119 extends so that the low-temperature heat exchanger 115*a* can be located in the boiler outer frame 119, it is possible to omit the extension work of the boiler outer frame 119 and reduce the installation space of the steam-generating plant.

Fifth Embodiment

Figure 5:
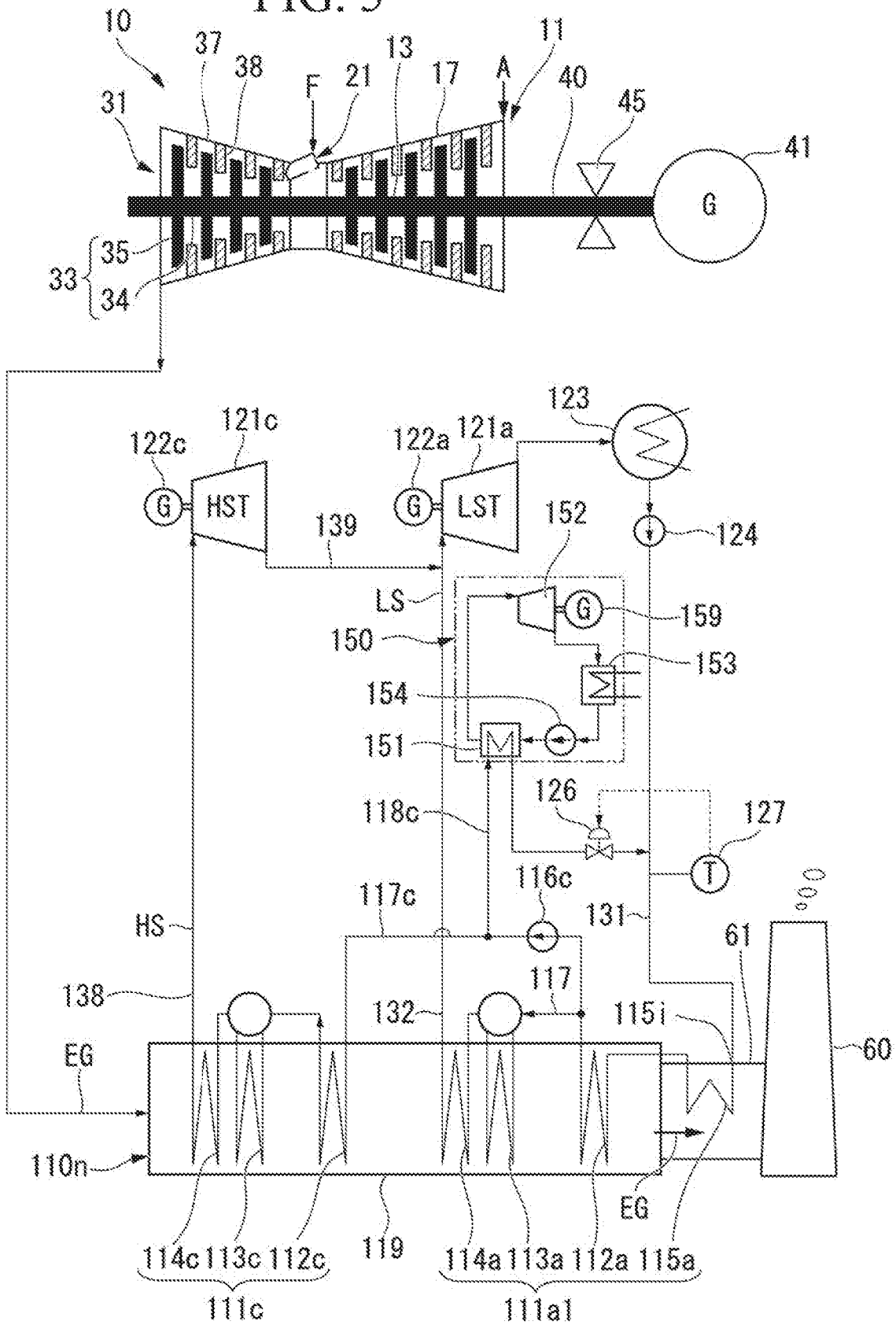
FIG. 5 is a system diagram of a steam-generating plant in a fifth embodiment according to the present invention.

A fifth embodiment of a boiler and a steam-generating plant including the boiler according to the present invention will be described with reference to FIG. 5.

The present embodiment is a modified example of the third embodiment described above. In the third embodiment described above, the low-temperature heat exchanger 115*a* is located in the boiler outer frame 119. In the present embodiment, a low-temperature heat exchanger 115*a* is located in a flue 61. The flue 61 is connected to a downstream end of the boiler outer frame 119. A stack 60 is connected to a downstream end of the flue 61. An exhaust gas EG from the boiler outer frame 119 passes through the flue 61 and the stack 60 and is released to the atmosphere from the stack 60.

As in the first embodiment, a water supply line 131 is connected to an inlet 115*i* of the low-temperature heat exchanger 115*a* in the present embodiment. An upstream side end of the low-temperature heat exchanger 115*a* is connected to a low-pressure economizer 112*a* in the boiler outer frame 119. Further, a connection between the upstream side end of the low-temperature heat exchanger 115*a* and the low-pressure economizer 112*a* may be a flange connection as in the first and third embodiments, but may also be a welded connection. In addition, the low-temperature heat exchanger 115*a* may be formed of a material having higher corrosion resistance than a material forming the low-pressure economizer 112*a* as in the first and third embodiments.

In the present embodiment, water from the water supply line is supplied to the low-temperature heat exchanger 115*a* in the flue 61. The low-temperature heat exchanger 115*a* cools the exhaust gas EG while heating the water by exchanging heat between the exhaust gas EG in the flue 61 and the water flowing therein (low-temperature heat exchange process). In the low-temperature heat exchanger 115*a*, water having a temperature lower than a dew point temperature of the exhaust gas EG is heated to a temperature higher than the dew point temperature. In addition, in the low-temperature heat exchanger 115*a*, the exhaust gas EG is cooled until the exhaust gas EG is condensed at least in a part of the low-temperature heat exchanger 115*a*, for example, locally in a surface of the low-temperature heat exchanger 115*a*. That is, as in the first and third embodiments, the low-temperature heat exchanger 115*a* also has a heat exchange ability to cool the exhaust gas EG until the exhaust gas EG is condensed at least in a part of the low-temperature heat exchanger 115*a* while heating the water by exchanging heat between the exhaust gas EG and the water flowing therein.

The water heated in the low-temperature heat exchanger 115*a* is introduced into the low-pressure economizer 112*a*. As in the embodiments described above, also in the low-pressure economizer 112*a*, the exhaust gas EG is cooled while water is heated by exchanging heat between the exhaust gas EG and the water flowing therein. In the low-pressure economizer 112*a*, the water having a temperature higher than the dew point temperature of the exhaust gas EG is heated to an even higher temperature. Also, in the low-pressure economizer 112*a*, the exhaust gas EG is cooled to a temperature higher than the dew point temperature thereof.

As in the third embodiment, since the low boiling point medium Rankine cycle 150 is provided also in the present embodiment and the low boiling point medium Rankine cycle 150 is driven by utilizing the heat of the exhaust gas EG, output and efficiency of the plant can be increased.

Further, in the present embodiment, since the low-temperature heat exchanger 115*a* is located in the flue 61, as compared with a case in which the boiler outer frame 119 extends so that the low-temperature heat exchanger 115*a* can be located in the boiler outer frame 119, it is possible to omit the extension work of the boiler outer frame 119 and reduce the installation space of the steam-generating plant as in the fourth embodiment.

Both the fourth embodiment described above and the present embodiment are modified examples of the third embodiment, but the low-temperature heat exchanger 115*a* may be located in the flue or stack also in the first embodiment.

Sixth Embodiment

Figure 6:
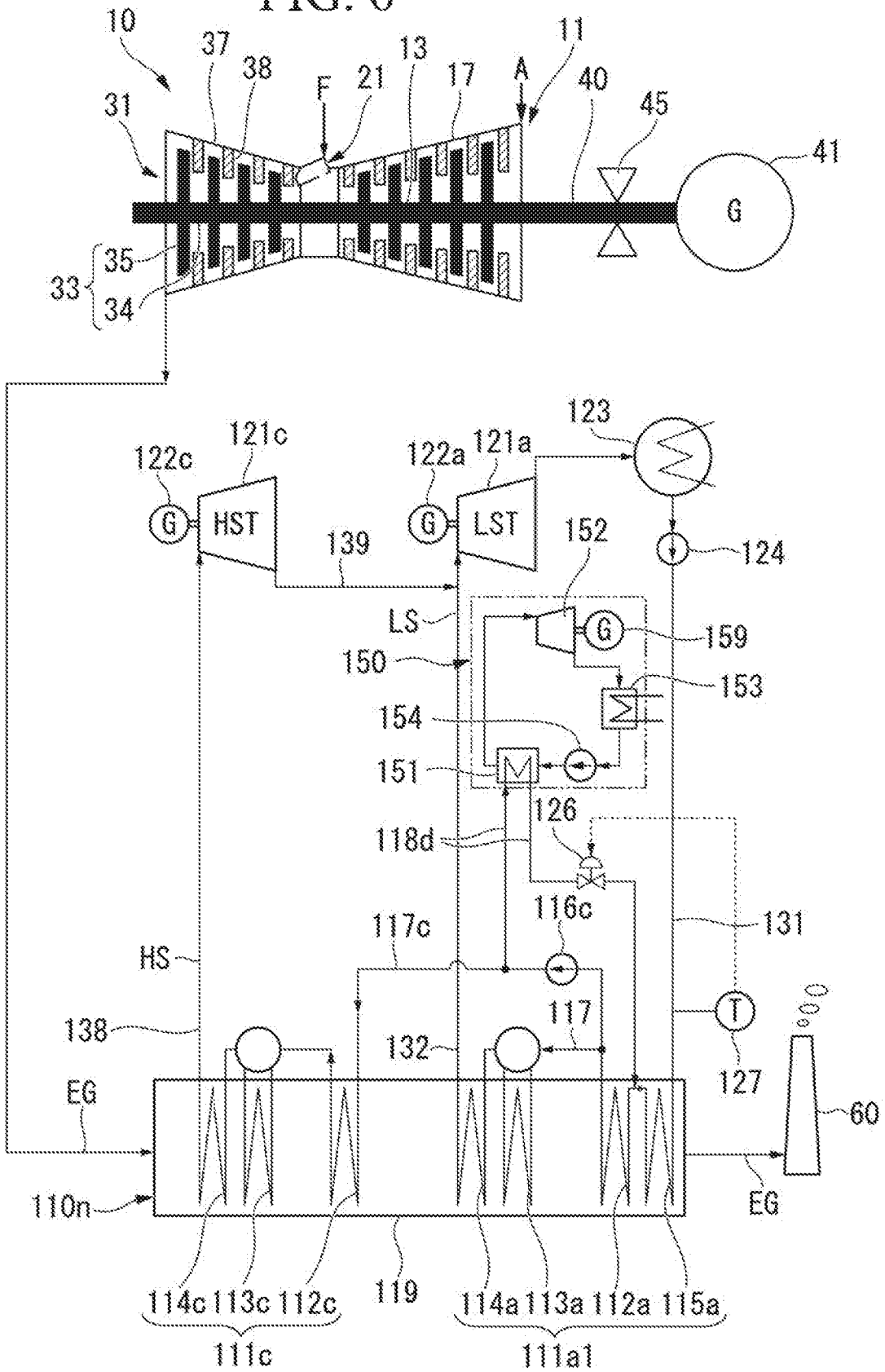
FIG. 6 is a system diagram of a steam-generating plant in a sixth embodiment according to the present invention.

A sixth embodiment of a boiler and a steam-generating plant including the boiler according to the present invention will be described with reference to FIG. 6.

The present embodiment is a modified example of the third embodiment. In the third embodiment described above, the heating water outlet in the evaporator 151 of the low boiling point medium Rankine cycle 150 is connected with the water supply line 131 by the low-pressure water circulation line 118*c*. In the present embodiment, a line between a low-pressure economizer 112*a* and a low-temperature heat exchanger 115*a* is connected with a heating water outlet in an evaporator 151 of a low boiling point medium Rankine cycle 150 by a low-pressure water circulation line 118*d*.

In the present embodiment, as in the third embodiment, also in the evaporator 151 of the low boiling point medium Rankine cycle 150, heat is exchanged between a liquid low boiling point medium and the water heated by the low-pressure economizer 112*a*, and the low boiling point medium is heated and evaporated (heating process). In this process, the water is cooled and flows out from the heating water outlet of the evaporator 151. The water that flows out from the heating water outlet of the evaporator 151 is introduced into the low-pressure economizer 112*a* via the low-pressure water circulation line 118*d* (water recovery process). The water heated by the low-temperature heat exchanger 115*a* is also introduced into the low-pressure economizer 112*a*.

When a temperature of water after exchanging heat with the liquid low boiling point medium by the evaporator 151 of the low boiling point medium Rankine cycle 150 is close to an inlet temperature of the low-pressure economizer 112*a*, as in the present embodiment, it is preferable that the water after exchanging heat with the liquid low boiling point medium by the evaporator 151 of the low boiling point medium Rankine cycle 150 be returned to between the low-pressure economizer 112*a* and the low-temperature heat exchanger 115*a*. This is because an amount of heat recovery in the low-temperature heat exchanger 115*a* increases.

Although the present embodiment is applied to the third embodiment, it may be applied to the fourth embodiment and the fifth embodiment.

Seventh Embodiment

Figure 7:
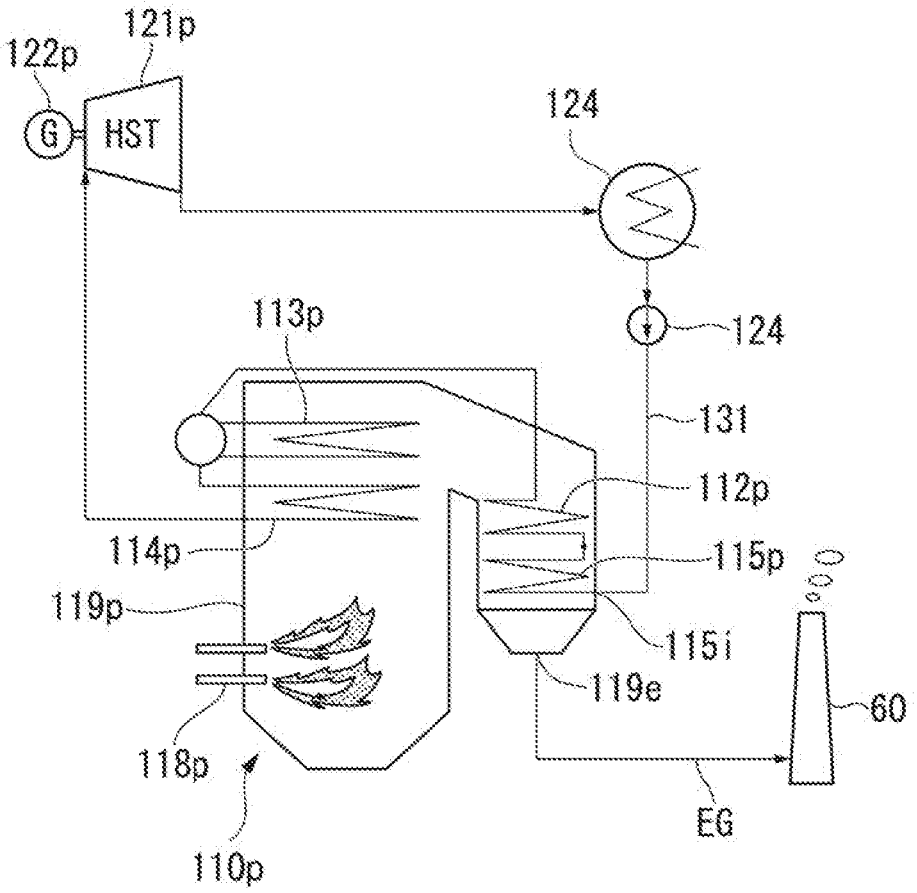
FIG. 7 is a system diagram of a steam-generating plant in a seventh embodiment according to the present invention.

A seventh embodiment of a boiler and a steam-generating plant including the boiler according to the present invention will be described with reference to FIG. 7.

All the boilers in the steam-generating plant of each embodiment described above are waste heat recovery boilers. However, the boiler may not necessarily be a waste heat recovery boiler, but may be a boiler generating combustion gas by itself by burning fuel. The steam-generating plant of the present embodiment is a plant including such a boiler.

The steam-generating plant of the present embodiment includes a boiler 110*p*, a steam turbine 121*p* driven by steam generated by the boiler 110*p*, a power generator 122*p* which generates electric power by driving of the steam turbine 121*p*, a steam condenser 123 which returns the steam which has driven the steam turbine 121*p* to water, and a water supply pump 124 which returns water in the steam condenser 123 to the boiler 110*p*.

The boiler 110*p* includes a boiler outer frame 119*p*, a burner 118*p* which injects fuel into the boiler outer frame 119*p*, a low-temperature heat exchanger 115*p* which heats water with a combustion gas generated by burning fuel, an economizer 112*p* which further heats the water heated by the low-temperature heat exchanger 115*p*, an evaporator 113*p* (the most downstream evaporator) which converts the water heated by the economizer 112*p* into steam, and a superheater 114*p* which superheats the steam generated by the evaporator 113*p*. All of the superheater 114*p*, the economizer 112*p*, and the low-temperature heat exchanger 115*p* are located in the boiler outer frame 119*p*. An evaporation drum which is a part of the evaporator 113*p* is located outside the boiler outer frame 119*p*. On the other hand, a heat transfer tube which is another part of the evaporator 113*p* is located in the boiler outer frame 119*p*. The superheater 114*p*, the evaporator 113*p*, the economizer 112*p*, and the low-temperature heat exchanger 115*p* are arranged in sequence toward the downstream side.

An upstream side end of the low-temperature heat exchanger 115*p* is connected to the economizer 112*p* by a flange connection as in the first embodiment of the steam-generating plant. An inlet 115*i* for receiving water from the outside is formed at a downstream side end of the low-temperature heat exchanger 115*p*. This low-temperature heat exchanger 115*p* also is formed of a material having higher corrosion resistance against condensate of the combustion gas than a material forming the economizer 112*p*.

The steam condenser 123 and the inlet 115*i* of the low-temperature heat exchanger 115*p* are connected by a water supply line 131. The water supply pump 124 described above is provided in the water supply line 131.

Also in the present embodiment, heat can be recovered from a low temperature combustion gas by the low-temperature heat exchanger 115*p*. Therefore, in the present embodiment, the heat in the combustion gas can be effectively utilized and efficiency of the steam-generating plant can be increased. In this way, the boiler may not be a waste heat recovery boiler, but may be any type of boiler as long as it has a steam generator and an economizer. Therefore, for example, the waste heat recovery boiler in each embodiment of the gas turbine plant described above may be used.

Also in the present embodiment, not only when a new boiler 110*p* is located but also when an existing boiler is remodeled, it is possible to increase efficiency of the existing boiler by additionally installing the low-temperature heat exchanger 115*p* described above.

Here, also in the present embodiment, the combustion gas having a temperature higher than a dew point temperature is cooled to a temperature equal to or higher than the dew point temperature by the low-temperature heat exchanger 115*p*. However, the combustion gas having a temperature higher than the dew point temperature or the combustion gas having a temperature equal to or higher than the dew point temperature may be cooled to a temperature lower than the dew point temperature by the low-temperature heat exchanger 115*p*.

Also in the present embodiment, the low-temperature heat exchanger 115*p* may be located in the flue or in the stack as in the fourth embodiment and the fifth embodiment.

Also in the present embodiment, the economizer 112*p* and the low-temperature heat exchanger 115*p* may be integrated as in the second embodiment of the steam-generating plant.

Also in the present embodiment, a low boiling point medium Rankine cycle may be added as in the third to sixth embodiments of the steam-generating plant. In this case, for example, as in the third embodiment, a low-pressure water circulation line (hot water line) for returning some of the water heated by the economizer 112*p* to the water supply line 131 is provided so that an evaporator or the like of the low boiling point medium Rankine cycle is provided in the line. Alternatively, for example, as in the sixth embodiment, a low-pressure water circulation line (hot water line) for returning some of the water heated by the economizer 112*p* back to the line between the economizer 112*p* and the low-temperature heat exchanger 115*p* is provided so that an evaporator or the like of the low boiling point medium Rankine cycle is provided in the low-pressure water circulation line.

Eighth Embodiment

Figure 8:
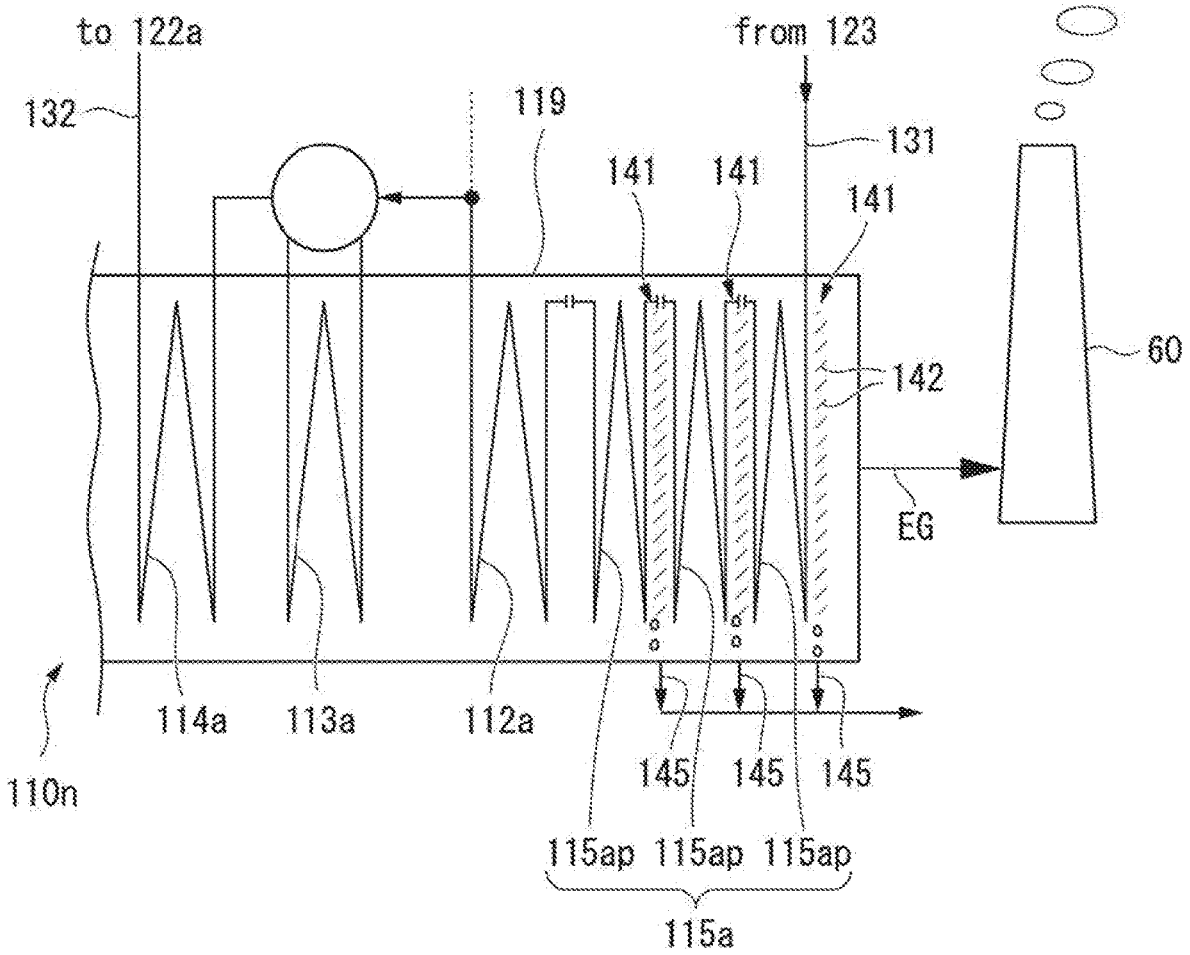
FIG. 8 is a system diagram of a boiler in an eighth embodiment according to the present invention.

An eighth embodiment of a boiler according to the present invention will be described with reference to FIG. 8.

A boiler 110*n* of the present embodiment is a modified example of the boiler of the first embodiment. The boiler 110*n* of the present embodiment includes a mist separator 141 which separates mist from an exhaust gas EG.

As in the first embodiment, a low-temperature heat exchanger 115*a* of the present embodiment is also located in a boiler outer frame 119 and on a downstream side of a flow of a combustion gas with respect to a low-pressure economizer 112*a*. An upstream side end of the low-temperature heat exchanger 115*a* is flange-connected to the low-pressure economizer 112*a*. The low-temperature heat exchanger 115*a* includes a plurality of low-temperature heat exchange portions 115*ap* arranged in upstream and downstream directions of the flow of the combustion gas. The plurality of low-temperature heat exchange portions 115*ap* are flange-connected to each other. For example, a flange is provided at an end on the downstream side of one low-temperature heat exchange portion 115*ap*, a flange is provided at an end on the upstream side of another low-temperature heat exchange portion 115*ap* disposed on the downstream side of the one low-temperature heat exchange portion 115*ap*, and both flanges are connected by bolts.

The mist separator 141 is disposed in upstream and downstream directions in a region in which the low-temperature heat exchanger 115*a* is disposed. Specifically, it is disposed in intervals between the plurality of low-temperature heat exchange portions 115*ap* in the upstream and downstream directions. The mist separator 141 is also disposed on the downstream side of the low-temperature heat exchanger 115*a*. The mist separator 141 is an inertial collision type mist separator. Specifically, the mist separator 141 includes a plurality of collision plates 142. In each collision plate 142, a vertical position of an upstream side end and a vertical position of a downstream side end are different. That is, each collision plate 142 is inclined with respect to the upstream and downstream directions. The plurality of collision plates 142 are disposed to be vertically arranged at intervals in a vertical direction.

Here, the plurality of collision plates 142 are arranged in the vertical direction. However, the plurality of collision plates 142 may be arranged in a direction crossing a flow of the exhaust gas EG in the boiler outer frame 119, and, for example, may be arranged in a horizontal direction perpendicular to the flow of the exhaust gas EG. In this case, in each collision plate 142, a horizontal position of the upstream side end and a horizontal position of the downstream side end are different.

Also, in the present embodiment, the mist separator 141 is constituted by the plurality of the collision plates 142. However, the mist separator 141 may have any form as long as it includes a member that serves the role of a collision plate for catching mist. Although the inertial collision type mist separator is employed here, another type of mist separator may also be employed.

A drain line 145 is connected to a portion positioned under the mist separator 141 at a portion of a bottom wall of the boiler outer frame 119. The drain line 145 opens at a position of an inner surface of the bottom wall of the boiler outer frame 119.

As in the embodiments described above, water is supplied to the low-temperature heat exchanger 115*a* of the present embodiment from a water supply line 131. Water below a dew point temperature of the exhaust gas EG is supplied to the low-temperature heat exchanger 115*a*. The low-temperature heat exchanger 115*a* cools the exhaust gas EG while heating water by exchanging heat between the exhaust gas EG and the water flowing therein (low temperature heat exchange process). The water is gradually heated in a process of flowing through the plurality of low-temperature heat exchange portions 115*ap* arranged in the upstream and downstream directions of the flow of the combustion gas toward the upstream side of the flow of the combustion gas, and a temperature of the water that has passed through the low-temperature heat exchange portions 115*ap* on the most upstream side is higher than the dew point temperature of the exhaust gas EG. The exhaust gas EG is gradually cooled in a process of flowing toward the downstream side in the region in which the plurality of low-temperature heat exchange portions 115*ap* are disposed. As described above, some of moisture in the exhaust gas EG condenses locally on a surface of the plurality of low-temperature heat exchange portions 115*ap*. In addition, an average temperature of the exhaust gas EG gradually decreases in the process of flowing toward the downstream side in the region in which the plurality of low-temperature heat exchange portions 115*ap* are disposed. Therefore, as the exhaust gas EG flows toward the downstream side in the region in which the low-temperature heat exchanger 115*a* is disposed, an amount of condensed moisture increases. The condensed moisture flows, as mist, in the boiler outer frame 119, and in a flue and a stack 60 on the further downstream side.

Condensed moisture is corrosive. Therefore, in the present embodiment, mist is separated from the exhaust gas EG by the mist separator 141 (mist separation process) to suppress corrosion of the boiler outer frame 119, the flue, or the like. Mist collides with the collision plates 142 which constitute the mist separator 141 and is condensed to form a liquid film. The liquid film flows downward and flows out of the drain line 145 via the drain line 145.

Therefore, in the present embodiment, it is possible to reduce an amount of mist flowing in the region in which the low-temperature heat exchanger 115*a* is disposed and an amount of mist flowing downstream from the low-temperature heat exchanger 115*a*. Therefore, in the present embodiment, corrosion of the low-temperature heat exchanger 115*a*, corrosion of the portion in which the low-temperature heat exchanger 115*a* is disposed and the downstream side thereof in the boiler outer frame 119, and corrosion of the flue or the like can be suppressed.

In addition, in the present embodiment, since the plurality of low-temperature heat exchange portions 115*ap* are flange-connected to each other, even when corrosion of one low-temperature heat exchange portion 115*ap* progresses, the one low-temperature heat exchange portion 115*ap* can be easily replaced with a new low-temperature heat exchange portion 115*ap*.

Further, the low-temperature heat exchanger 115*a* of the present embodiment includes three low-temperature heat exchange portions 115*ap*. However, the number of low-temperature heat exchange portions 115*ap* may be two, four or more. An amount of heat recovery from the low temperature exhaust gas EG increases as the number of low-temperature heat exchange portions 115*ap* arranged in the upstream and downstream directions of the flow of the combustion gas increases. When the mist separator 141 is disposed in intervals between the plurality of low-temperature heat exchange portions 115*ap*, a collection rate of the mist increases as the number of low-temperature heat exchange portions 115*ap* increases and an amount of condensed moisture in the exhaust gas EG can be reduced by sequentially recovering generated mist. Therefore, in this case, the effect of preventing corrosion in the boiler outer frame 119 or the like can be enhanced. On the other hand, as the number of low-temperature heat exchange portions 115*ap* increases, installation cost increases. Therefore, it is preferable to determine the number of low-temperature heat exchange portions 115*ap* by comparing an increase in waste heat recovery amount, a corrosion preventing effect, and an increase in equipment cost.

In addition, the low-temperature heat exchanger 115*a* may have only one low-temperature heat exchange portion 115*ap*. In this case, the mist separator 141 is provided at an intermediate portion in the upstream and downstream directions of one low-temperature heat exchange portion 115*ap*, if necessary, on the downstream side from the intermediate portion.

In the present embodiment, the mist separator 141 is disposed at intervals between the plurality of low-temperature heat exchange portions 115*ap* and also on the downstream side of the low-temperature heat exchanger 115*a*. However, the mist separator 141 may be disposed at any one of the positions exemplarily shown above.

In the present embodiment, the plurality of low-temperature heat exchange portions 115*ap* are flange-connected to each other. However, when the low-temperature heat exchange portion 115*ap* is formed of a corrosion-resistant material, for example, such as stainless steel, the plurality of low-temperature heat exchange portions 115*ap* may be welded to each other, for example.

In the present embodiment, the low-temperature heat exchanger 115*a* is disposed in the boiler outer frame 119, and the mist separator 141 is disposed in the region in which the low-temperature heat exchanger 115*a* is disposed. However, even when the low-temperature heat exchanger 115*a* is disposed in the stack 60 as shown in FIG. 4 or the low-temperature heat exchanger 115*a* is disposed in the flue 61 as shown in FIG. 5, it is preferable to dispose the mist separator 141 in the region in which the low-temperature heat exchanger 115*a* is disposed.

In addition, the steam-generating plant of each embodiment described above includes a steam turbine. However, a steam-generating plant may not include a steam turbine. In this case, the steam generated in the steam-generating plant is used as a heating source for a reactor or the like in a chemical plant, for example, and as a heat source for heating a building.

INDUSTRIAL APPLICABILITY

According to one aspect of the present invention, heat in combustion gas can be effectively utilized.

REFERENCE SIGNS LIST

10 Gas turbine
11 Compressor
21 Combustor
31 Turbine
33 Turbine rotor
40 Gas turbine rotor
45 Shaft bearing
110*n*, 110*o* Waste heat recovery boiler
110*p* Boiler
111*a*1, 111*a*2 Low-pressure steam generating portion
111*b* Medium-pressure steam generating portion
111*c* High-pressure steam generating portion
112*a*, 112*d* Low-pressure economizer
112*i* Inlet
112*p* Economizer
113*a* Low-pressure evaporator (most downstream evaporator)
113*p* Evaporator (most downstream evaporator)
114*a* Low-pressure superheater
114*p* Superheater
115*a*, 115*p* Low-temperature heat exchanger
115*i* Inlet
115*ap* Low-temperature heat exchange portion
117 Low-pressure water line
117*c* Low-pressure water branch line
118*c*, 118*d* Low-pressure water circulation line (hot water line)
119, 119*p* Boiler outer frame
119*e* Exhaust port
123 Steam condenser
124 Water supply pump
126 Flow rate adjusting valve
127 Thermometer
131 Water supply line
132 Low-pressure steam line
138 High-pressure steam line
139 High-pressure steam recovery line
141 Mist separator
145 Drain line
150 Low boiling point medium Rankine cycle
151 Evaporator (heater)
152 Turbine
153 Condenser
154 Low boiling point medium pump

The invention claimed is:

1. A boiler comprising:

a boiler outer frame through which a combustion gas flows toward a downstream side which is an exhaust port side;

one or more evaporators having at least a portion thereof located in the boiler outer frame and configured to heat water with the combustion gas to generate steam;

an economizer located on the downstream side of the most downstream evaporator which is an evaporator at the most downstream side among the one or more evaporators in the boiler outer frame and configured to heat water sent to the most downstream evaporator with the combustion gas;

a low-temperature heat exchanger located on the downstream side of the economizer, having an inlet which receives water from the outside, and configured to heat the water introduced from the inlet and sent to the economizer with the combustion gas; and a mist separator which separates mist liquefied from moisture contained in the combustion gas from the combustion gas, wherein the mist separator is disposed in a region in which the low-temperature heat exchanger is disposed and/or on the downstream side of the region in upstream and downstream directions in which the combustion gas flows and is away from the low-temperature heat exchanger, wherein the low-temperature heat exchanger includes a plurality of low-temperature heat exchange portions arranged in the upstream and downstream directions, wherein the mist separator is disposed at least at one interval among intervals between the plurality of low-temperature heat exchange portions in the upstream and downstream directions, and wherein the mist separator is disposed at least at a plurality of positions including the intervals between the plurality of low-temperature heat exchanger portions, and the downstream side of the low-temperature heat exchanger portion disposed at the most downstream side in the upstream and the downstream directions.

2. A method for operating a boiler, the boiler including:

a boiler outer frame through which a combustion gas flows toward a downstream side which is an exhaust port side;

one or more evaporators having at least a portion thereof located in the boiler outer frame and configured to heat water with the combustion gas to generate steam;

an economizer located on the downstream side of the most downstream evaporator which is an evaporator at the most downstream side among the one or more evaporators in the boiler outer frame and configured to heat water sent to the most downstream evaporator with the combustion gas; and a low-temperature heat exchanger located on the downstream side of the economizer and configured to heat water sent to the economizer with the combustion gas, the method including executing:

an economizer heat exchange process of causing the economizer to exchange heat between the combustion gas and water flowing therein to cool the combustion gas to a temperature higher than a dew point temperature of the combustion gas while heating the water;

a low-temperature heat exchange process of causing the low-temperature heat exchanger to exchange heat between the combustion gas cooled by heat exchange in the economizer and water flowing therein to cool the combustion gas until the combustion gas is condensed at least in a part of the low-temperature heat exchanger while heating the water; and a mist separation process of separating mist liquefied from moisture by a mist separator in a region in which the low-temperature heat exchanger is disposed and/or on the downstream side of the region in upstream and downstream directions in which the combustion gas flows, the moisture being contained in the combustion gas from the combustion gas, wherein the mist separator is away from the low-temperature heat exchanger, wherein the low-temperature heat exchanger includes a plurality of low-temperature heat exchange portions arranged in the upstream and downstream directions, wherein the mist separator is disposed at least at one interval among intervals between the plurality of low-temperature heat exchange portions in the upstream and downstream directions, and wherein the mist separator is disposed at least at a plurality of positions including the intervals between the plurality of low-temperature heat exchanger portions, and the downstream side of the low-temperature heat exchanger portion disposed at the most downstream side in the upstream and the downstream directions.

* * * * *